US011653723B1

(12) United States Patent
Wu

(10) Patent No.: US 11,653,723 B1
(45) Date of Patent: May 23, 2023

(54) SAFETY BELT LATCH ASSEMBLY

(71) Applicant: Taiwan Racing Products Co., Ltd., Changhua Hsien (TW)

(72) Inventor: Wen-Yuan Wu, Changhua Hsien (TW)

(73) Assignee: Taiwan Racing Products Co., Ltd., Changhua Hsien (TW)

( * ) Notice: Subject to any disclaimer, the term of this patent is extended or adjusted under 35 U.S.C. 154(b) by 0 days.

(21) Appl. No.: 17/721,433

(22) Filed: Apr. 15, 2022

(51) Int. Cl.
*A44B 11/25* (2006.01)

(52) U.S. Cl.
CPC ..... *A44B 11/2557* (2013.01); *A44B 11/2561* (2013.01)

(58) Field of Classification Search
CPC ..... A44B 11/2561; A44B 11/2546; A44B 11/2503; A44B 11/2557; Y10T 24/4028; Y10T 24/45241
See application file for complete search history.

(56) References Cited

U.S. PATENT DOCUMENTS

2010/0264707 A1* 10/2010 Tang ..... B60N 2/2812 24/593.1

FOREIGN PATENT DOCUMENTS

WO WO-9009747 A1 * 9/1999 ..... B60N 2/286

* cited by examiner

*Primary Examiner* — Robert Sandy
*Assistant Examiner* — Michael S Lee
(74) *Attorney, Agent, or Firm* — Karin L. Williams; Mayer & Williams PC

(57) ABSTRACT

A safety belt latch assembly includes an adjusting section, a snap-fit piece, and a strap winding bar. The adjusting section is provided with an opening and two side plates. Each of the side plates of the adjusting section is provided with an elongate slot. The snap-fit piece has a first end provided with a torsion portion twisted from the adjusting section, with a torsion angle of ninety degrees (90°) being defined between the snap-fit piece and the adjusting section. The snap-fit piece has a second end provided with a fastening portion having a fastening hole. The strap winding bar is provided with two contact portions. Each of the contact portions of the strap winding bar is inserted into the elongate slot of one of the side plates of the adjusting section.

10 Claims, 5 Drawing Sheets

SAFETY BELT LATCH ASSEMBLY

BACKGROUND OF THE INVENTION

1. Field of the Invention

The present invention relates to a latch assembly and, more particularly, to a safety belt latch assembly for a car.

2. Description of the Related Art

A safety belt latch is used to secure a safety belt on a user when sitting on the seat of a car. Thus, the pull strap of the safety belt is connected by the safety belt latch and placed on a fixed position. The safety belt latch includes a buckle secured on the seat of the car and a latch plate or fastener connected with the pull strap of the safety belt and detachably connected with the buckle. A conventional multi-point safety belt latch includes multiple buckles mounted on a periphery of the seat and multiple fasteners connected with the buckles to connect multiple pull straps to the user's body, including two shoulders, two arms, the crotch, and the abdomen, so as to support the user's body efficiently, thereby providing a buffering effect, and preventing the user from being hurt when subjected to an accidental impact. However, when the conventional multi-point safety belt latch is mounted on the position of the user's crotch, the length of the pull strap under the crotch is fixed and cannot be adjusted according to the user's size, so that the conventional multi-point safety belt latch is not available for users of different statures, thereby greatly limiting the versatility of the conventional multi-point safety belt latch.

BRIEF SUMMARY OF THE INVENTION

The primary objective of the present invention is to provide a safety belt latch assembly that is used to connect the safety belt at the position of the user's crotch.

In accordance with the present invention, there is provided a safety belt latch assembly comprising an adjusting section, a snap-fit piece, and a strap winding bar. The adjusting section has a sheet shape. The adjusting section is provided with an opening. The opening of the adjusting section has a rectangular shape. The adjusting section is provided with two side plates formed on two sides thereof. The two side plates of the adjusting section are arranged symmetrically, Each of the two side plates of the adjusting section has a bent shape. Each of the two side plates of the adjusting section is provided with an elongate slot. The elongate slots of the two side plates are arranged symmetrically. The snap-fit piece extends from the adjusting section laterally. The snap-fit piece has a first end provided with a torsion portion. The torsion portion of the snap-fit piece connects the adjusting section. The snap-fit piece is twisted from the adjusting section at the torsion portion, with a torsion angle of ninety degrees (90°) being defined between the snap-fit piece and the adjusting section. The snap-fit piece has a second end provided with a fastening portion. The fastening portion of the snap-fit piece is provided with a fastening hole. The strap winding bar is mounted on the adjusting section. The strap winding bar is provided with two contact portions formed on two ends thereof. Each of the two contact portions has a flat shape. Each of the two contact portions of the strap winding bar is inserted into the elongate slot of one of the two side plates of the adjusting section. Thus, the strap winding bar is limited between the two side plates of the adjusting section. In addition, each of the two contact portions of the strap winding bar is movable in and limited by the elongate slot of of the of the two side plates of the adjusting section so that the strap winding bar is slidable relative to the adjusting section.

Preferably, the adjusting section and the snap-fit piece are formed integrally by a sheet plate which is bent and twisted.

Preferably, the strap winding bar is provided with an anti-skid portion.

Preferably, the anti-skid portion of the strap winding bar presents an embossing pattern.

Preferably, the adjusting section is provided with a strap passage, and a pull strap passes through and is wound around the strap passage of the adjusting section. The strap passage of the adjusting section and the snap-fit piece extend in two opposite directions.

Preferably, the safety belt latch assembly further comprises two reinforcing pieces mounted on the adjusting section and juxtaposed to the two side plates of the adjusting section respectively.

Preferably, each of the two reinforcing pieces is affixed to one of the two side plates of the adjusting section by brazing or sticking.

Preferably, the fastening portion of the snap-fit piece has a width more than that of the torsion portion.

Preferably, the strap winding bar has a lower edge slidably received in the opening of the adjusting section.

Preferably, the safety belt latch assembly further comprises a protecting layer coating and covering the adjusting section, the two side plates of the adjusting section, and the snap-fit piece. The protecting layer is applied on the adjusting section and the snap-fit piece by baking paint or heat treatment after the two side plates of the adjusting section are bent and the snap-fit piece is twisted.

According to the primary advantage of the present invention, the safety belt latch assembly is used to connect the safety belt at the position of the user's crotch.

According to another advantage of the present invention, the length of the safety belt can be adjusted properly.

According to a further advantage of the present invention, the safety belt latch assembly is used to press and tighten the safety belt.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
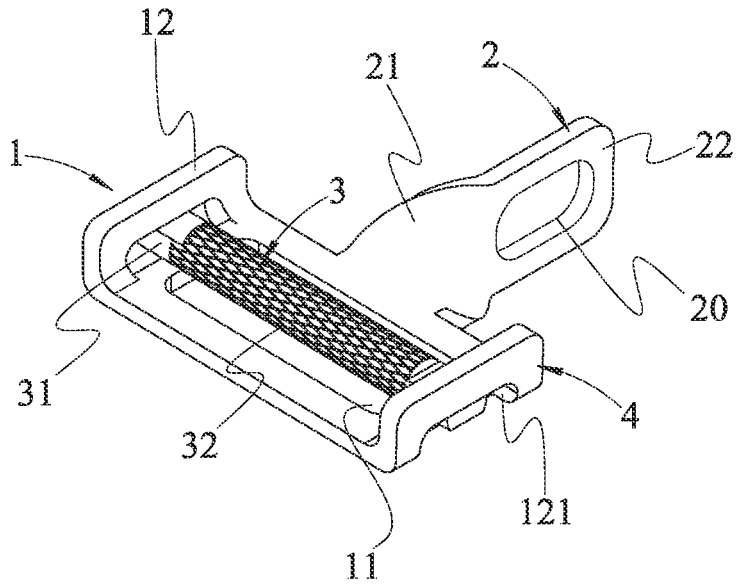
FIG. 1 is a perspective view of a safety belt latch assembly in accordance with the preferred embodiment of the present invention.
Figure 2:
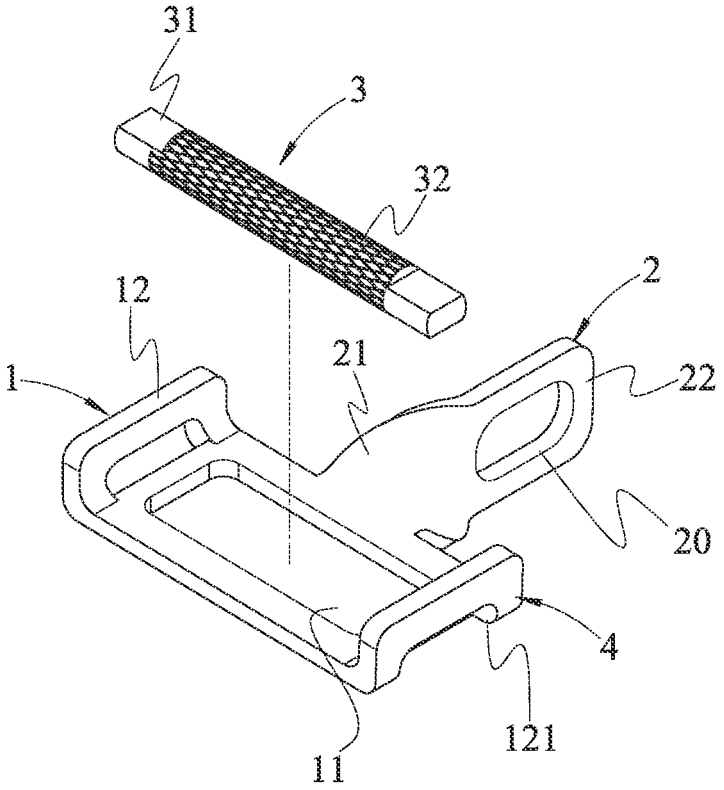
FIG. 2 is an exploded perspective view of the safety belt latch assembly in accordance with the preferred embodiment of the present invention.
Figure 3:
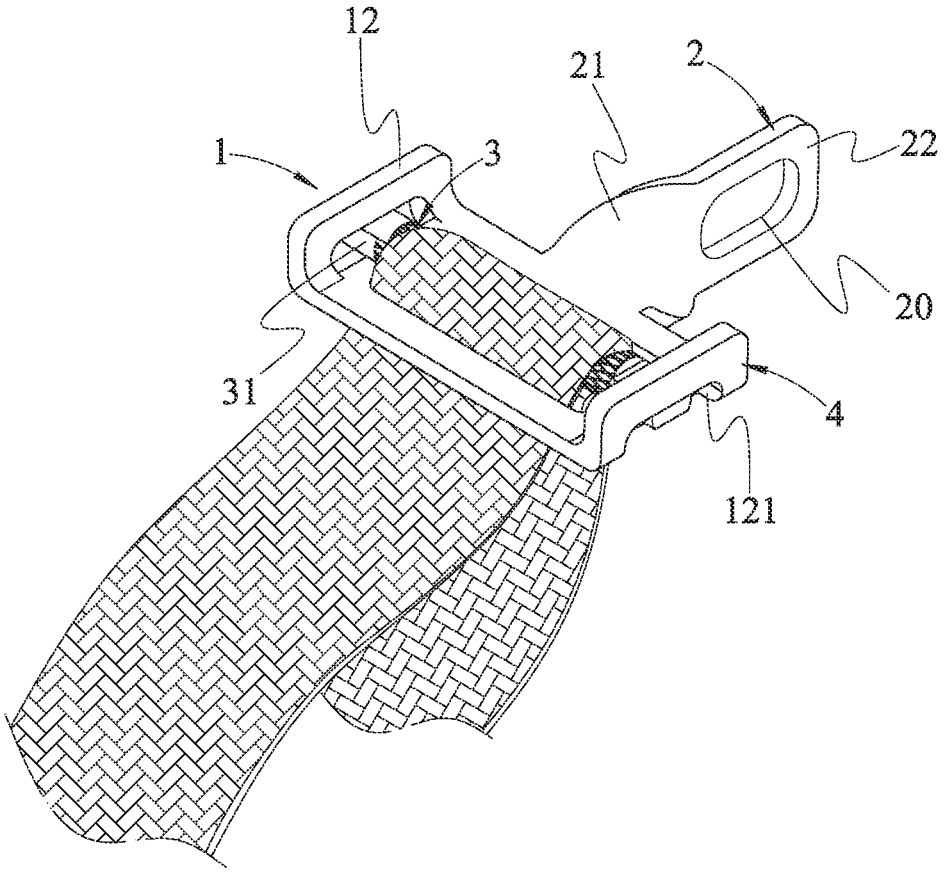
FIG. 3 is a perspective view showing the safety belt latch assembly connected with a pull strap.

Referring to the drawings and initially to FIGS. 1-3, a safety belt latch assembly in accordance with the preferred embodiment of the present invention comprises an adjusting section (or bracket) 1, a snap-fit (or locking or fastening or closure) piece 2, and a strap winding bar (or an adjusting lever) 3.

The adjusting section 1 has a sheet shape. The adjusting section 1 is provided with an opening 11. The opening 11 of the adjusting section 1 has a rectangular shape. The adjusting section 1 is provided with two side plates 12 formed on two sides thereof. The two side plates 12 of the adjusting section 1 are arranged symmetrically. Each of the two side plates 12 of the adjusting section 1 has a bent shape. Each of the two side plates 12 of the adjusting section 1 is provided with an elongate slot 121. The elongate slots 121 of the two side plates 12 are arranged symmetrically.

The snap-fit piece 2 extends from the adjusting section 1 laterally. The snap-fit piece 2 has a first end provided with a torsion (or twist) portion 21. The torsion portion 21 of the snap-fit piece 2 connects the adjusting section 1. The snap-fit piece is twisted from the adjusting section 1 at the torsion portion 21, with a torsion angle of ninety degrees (90°) being defined between the snap-fit piece 2 and the adjusting section 1, The snap-fit piece 2 has a second end provided with a fastening portion 22. The fastening portion 22 of the snap-fit piece 2 is provided with a fastening hole 20.

The strap winding bar 3 is mounted on the adjusting section 1. The strap winding bar 3 is provided with two contact (or adjusting) portions 31 formed on two ends thereof. Each of the two contact portions 31 has a flat shape. Each of the two contact portions 31 of the strap winding bar 3 is inserted into the elongate slot 121 of one of the two side plates 12 of the adjusting section 1 so that each of the two contact portions 31 of the strap winding bar 3 is limited by one of the two side plates 12 of the adjusting section 1. Thus, the strap winding bar 3 is limited between the two side plates 12 of the adjusting section 1. In addition, each of the two contact portions 31 of the strap winding bar 3 is movable in and limited by the elongate slot 121 of one of the two side plates 12 of the adjusting section 1 so that the strap winding bar 3 is slidable relative to the adjusting section 1. A pull strap of the safety belt passes through the opening 11 of the adjusting section 1 and is wound around the strap winding bar 3. Thus, the strap winding bar 3 is moved relative to the adjusting section 1 to adjust the position of the pull strap.

In the preferred embodiment of the present invention, the adjusting section 1 and the snap-fit piece 2 are formed integrally by a sheet plate which is bent and twisted to form the adjusting section 1 and the snap-fit piece 2. The sheet plate is made of metal.

In fabrication, the sheet plate is stamped (or punched), cut, and twisted to form the adjusting section 1, the two side plates 12 of the adjusting section 1, and the snap-fit piece 2, wherein the adjusting section 1 is formed with the opening 11, each of the two side plates 12 of the adjusting section 1 is formed with the elongate slot 121, and the snap-fit piece 2 is formed with the fastening portion 22. Thus, the whole sheet plate is worked to form the adjusting section 1 and the snap-fit piece 2 integrally to enhance the tensile strength of the adjusting section 1 and the snap-fit piece 2 when the safety belt is subjected to an impact. In addition, the sheet plate maintains the metallic strength when the snap-fit piece 2 is twisted from the adjusting section 1 to form the torsion portion 21.

In the preferred embodiment of the present invention, the strap winding bar 3 is provided with an anti-skid portion 32, Thus, when the pull strap of the safety belt is wound around the strap winding bar 3, the anti-skid portion 32 prevents the strap of the safety belt from slipping on the strap winding bar 3. In addition, the anti-skid portion 32 of the strap winding bar 3 keeps the length of the pull strap when the safety belt is stretched and tightened.

In the preferred embodiment of the present invention, the anti-skid portion 32 of the strap winding bar 3 presents an embossing pattern or a knurling. Thus, the anti-skid portion 32 of the strap winding bar 3 increases the friction to enhance the safety.

In the preferred embodiment of the present invention, the fastening portion 22 of the snap-fit piece 2 has a width more than that of the torsion portion 21.

In the preferred embodiment of the present invention, the strap winding bar 3 has a lower edge slidably received in the opening 11 of the adjusting section 1.

In the preferred embodiment of the present invention, the safety belt latch assembly further comprises a protecting layer 4 coating and covering the adjusting section 1, the two side plates 12 of the adjusting section 1, and the snap-fit piece 2. In fabrication, the protecting layer 4 is applied on the adjusting section 1 and the snap-fit piece 2 by baking paint or heat treatment after the two side plates 12 of the adjusting section 1 are bent and the snap-fit piece 2 is twisted.

In practice, the safety belt latch assembly of the present invention is available for a multi-point safety belt, and is located at a seat position corresponding to a user's crotch. When the fastening portion 22 of the snap-fit piece 2 is inserted into a buckle, the fastening hole 20 of the fastening portion 22 is locked onto a hooked portion of the buckle, so that the snap-fit piece 2 is securely attached to the buckle, thereby positioning the safety belt latch assembly in place.

It is appreciated that, the fastening portion 22 of the snap-fit piece 2 has a width more than that of the torsion portion 21. Thus, the torsion portion 21 will not interfere with the snap connection of the fastening portion 22 and the buckle so that the snap-fit piece 2 is connected with the buckle easily. In addition, the strap winding bar 3 has a lower edge slidably received in the opening 11 of the adjusting section 1, so that when the pull strap passes through the opening 11 of the adjusting section 1 and is wound around the strap winding bar 3, the pull strap is curved and will not be pulled or drawn easily to prevent the pull strap from slipping.

Figure 4:
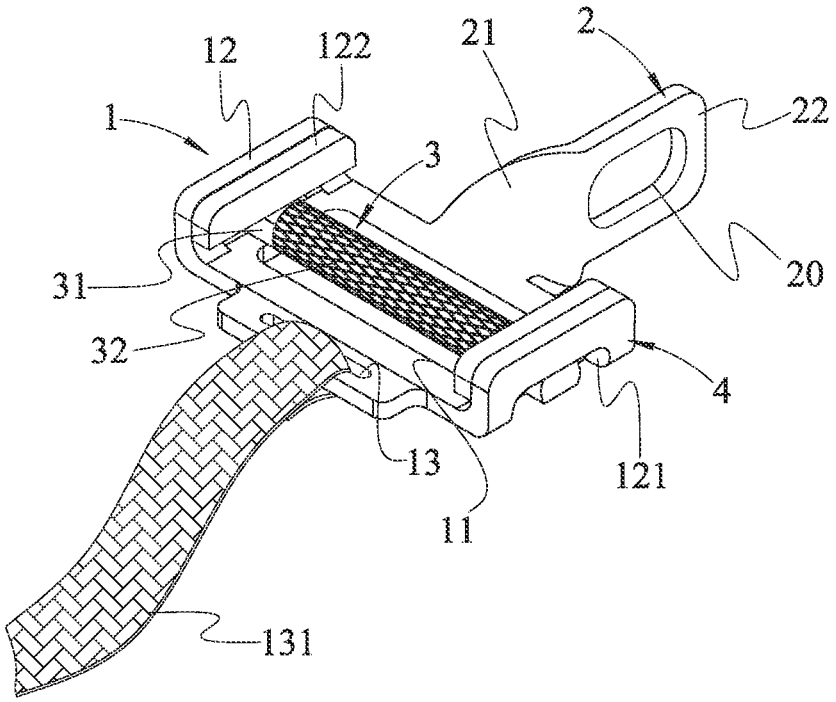
FIG. 4 is a perspective view of a safety belt latch assembly in accordance with another preferred embodiment of the present invention.
Figure 5:
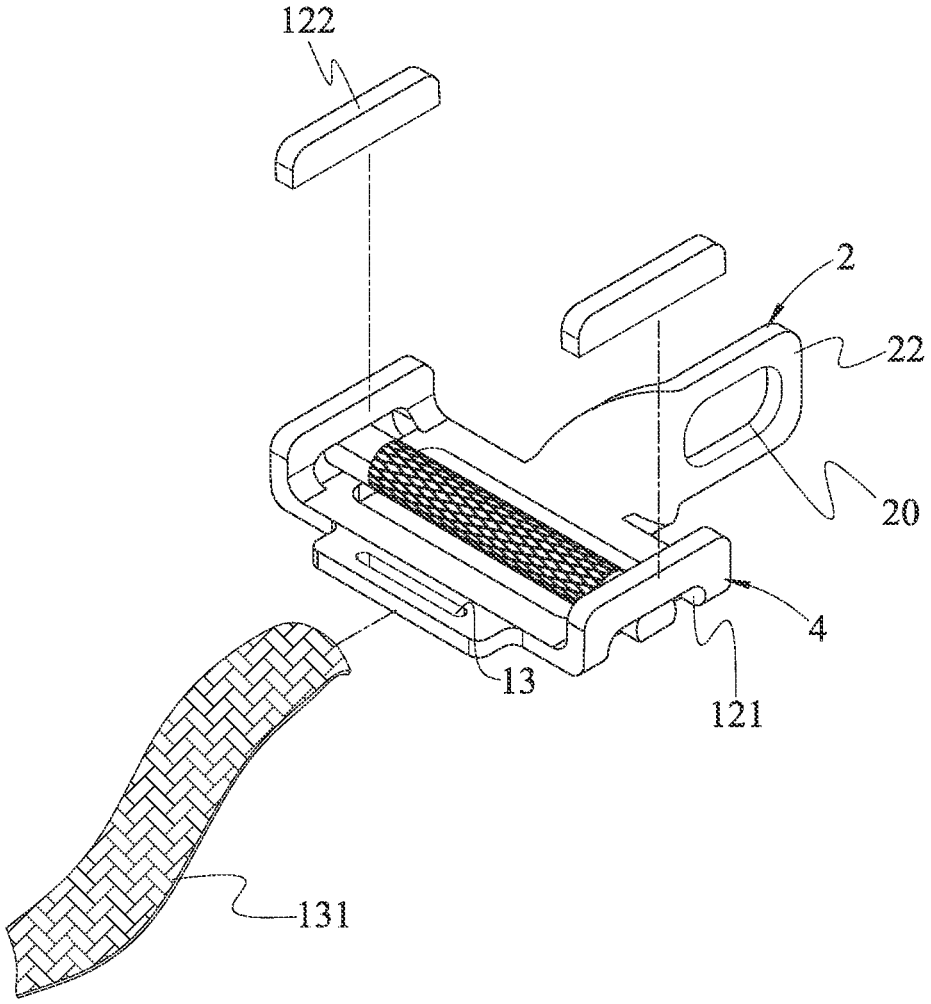
FIG. 5 is an exploded perspective view of the safety belt latch assembly as shown in FIG. 4.

Referring to FIGS. 4 and 5, the adjusting section 1 is provided with a strap passage 13, and a pull strap 131 passes through and is wound around the strap passage 13 of the adjusting section 1. The strap passage 13 of the adjusting section 1 and the snap-fit piece 2 extend in two opposite directions. Thus, the pull strap 131 is drawn by the strap passage 13 of the adjusting section 1 to fix the position of the adjusting section 1 so that the pull strap 131 is pulled and adjusted easily and conveniently. The safety belt latch assembly further comprises two reinforcing pieces 122 mounted on the adjusting section 1 and juxtaposed to the two side plates 12 of the adjusting section 1 respectively. The two reinforcing pieces 122 contact the two contact portions 31 of the strap winding bar 3 respectively to increase the contact area of each of the two contact portions 31 of the strap winding bar 3 and each of the two side plates 12 of the adjusting section 1, so as to reinforce the strength of the adjusting section 1, thereby preventing from incurring a metallic deformation due to an impact. Each of the two reinforcing pieces 122 is affixed to one of the two side plates 12 of the adjusting section 1 by brazing, soldering or sticking, thereby simplifying the process of fabrication.

In conclusion, the snap-fit piece 2 is twisted from the adjusting section 1 at the torsion portion 21, with a torsion angle of ninety degrees (90°) being defined between the fastening portion 22 of the snap-fit piece 2 and the adjusting section 1, so that the fastening portion 22 of the snap-fit piece 2 is easily and steadily inserted into the buckle at the position of the user's crotch. Moreover, the pull strap passes through the opening 11 of the adjusting section 1 and is wound around the strap winding bar 3, so that it is easy to adjust the length of the safety belt at the position of the user's crotch.

Accordingly, the safety belt latch assembly is used to connect the safety belt at the position of the user's crotch. In addition, the length of the safety belt can be adjusted properly. Further, the safety belt latch assembly is used to press and tighten the safety belt.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A safety belt latch assembly comprising:

an adjusting section, a snap-fit piece, and a strap winding bar;

wherein:

the adjusting section has a sheet shape;

the adjusting section is provided with an opening;

the opening of the adjusting section has a rectangular shape;

the adjusting section is provided with two side plates formed on sides thereof;

the two side plates of the adjusting section are arranged symmetrically;

each of the two side plates of the adjusting section has a bent shape;

each of the two side plates of the adjusting section is provided with an elongate slot;

the elongate slots of the two side plates are arranged symmetrically;

the snap-fit piece extends from the adjusting section laterally;

the snap-fit piece has a first end provided with a torsion portion;

the torsion portion of the snap-fit piece connects the adjusting section;

the snap-fit piece is twisted from the adjusting section at the torsion portion, with a torsion angle of ninety degrees (90°) being defined between the snap-fit piece and the adjusting section;

the snap-fit piece has a second end provided with a fastening portion;

the fastening portion of the snap-fit piece is provided with a fastening hole;

the strap winding bar is mounted on the adjusting section;

the strap winding bar is provided with two contact portions formed on two ends thereof;

each of the two contact portions has a flat shape;

each of the two contact portions of the strap winding bar is inserted into the elongate slot of one of the two side plates of the adjusting section;

the strap winding bar is limited between the two side plates of the adjusting section; and each of the two contact portions of the strap winding bar is movable in and limited by the elongate slot of one of the two side plates of the adjusting section so that the strap winding bar is slidable relative to the adjusting section.

2. The safety belt latch assembly as claimed in claim 1, wherein the adjusting section and the snap-fit piece are formed integrally by a sheet plate which is bent and twisted.

3. The safety belt latch assembly as claimed in claim 1, wherein the strap winding bar is provided with an anti-skid portion.

4. The safety belt latch assembly as claimed in claim 3, wherein the anti-skid portion of the strap winding bar presents an embossing pattern.

5. The safety belt latch assembly as claimed in claim 1, wherein:

the adjusting section is provided with a strap passage;

a pull strap passes through and is wound around the strap passage of the adjusting section; and the strap passage of the adjusting section and the snap-fit piece extend in two opposite directions.

6. The safety belt latch assembly as claimed in claim 1, further comprising:

two reinforcing pieces mounted on the adjusting section and juxtaposed to the two side plates of the adjusting section respectively.

7. The safety belt latch assembly as claimed in claim 6, wherein each of the two reinforcing pieces is affixed to one of the two side plates of the adjusting section by brazing or sticking.

8. The safety belt latch assembly as claimed in claim 1, wherein the fastening portion of the snap-fit piece has a width more than that of the torsion portion.

9. The safety belt latch assembly as claimed in claim 1, wherein the strap winding bar has a lower edge slidably received in the opening of the adjusting section.

10. The safety belt latch assembly as claimed in claim 1, further comprising:

a protecting layer coating and covering the adjusting section, the two side plates of the adjusting section, and the snap-fit piece;

wherein the protecting layer is applied on the adjusting section and the snap-fit piece by baking paint or heat treatment after the two side plates of the adjusting section are bent and the snap-fit piece is twisted.

* * * * *